US008387295B2

(12) United States Patent
Glock

(10) Patent No.: US 8,387,295 B2
(45) Date of Patent: Mar. 5, 2013

(54) HANDGUN

(76) Inventor: Gaston Glock, Velden am Woerthersee (AT)

( * ) Notice: Subject to any disclaimer, the term of this patent is extended or adjusted under 35 U.S.C. 154(b) by 1474 days.

(21) Appl. No.: 11/986,297

(22) Filed: Nov. 20, 2007

(65) Prior Publication Data

US 2012/0144711 A1 Jun. 14, 2012

(30) Foreign Application Priority Data

Nov. 22, 2006 (EP) ..... 06024167

(51) Int. Cl.
*F41A 9/62* (2006.01)

(52) U.S. Cl. ..... 42/1.02

(58) Field of Classification Search ..... 42/1.01, 42/1.02, 1.03, 1.05
See application file for complete search history.

(56) References Cited

U.S. PATENT DOCUMENTS

| | | | | |
|---|---|---|---|---|
| 6,643,968 | B2 | 11/2003 | Glock | |
| 7,669,356 | B2 * | 3/2010 | Joannes et al. | 42/1.01 |
| 7,716,863 | B1 * | 5/2010 | Johnson et al. | 42/1.02 |
| 2005/0114084 | A1 | 5/2005 | Johnson et al. | |
| 2006/0277808 | A1 * | 12/2006 | Danner et al. | 42/70.09 |

FOREIGN PATENT DOCUMENTS

| | | | |
|---|---|---|---|
| DE | 40 22 038 | A1 * | 1/1992 |
| EP | 1 300 648 | B1 | 12/2003 |

* cited by examiner

*Primary Examiner* — Stephen M Johnson
(74) *Attorney, Agent, or Firm* — Miller Canfield Paddock and Stone; Mark L Maki

(57) ABSTRACT

A handgun having a device for ascertaining the shot count has electronics having a microprocessor (18) and a memory which may be read out, as well as an acceleration sensor (22), which detects the acceleration of the firearm in at least one spatial direction. Reference values for the intensity curve of the acceleration measured by the acceleration sensor (22) upon firing the weapon are stored in the memory. The microprocessor (18) is designed in such a way that it outputs a count pulse to the memory in the event of positive comparison of an intensity curve of the acceleration measured using the acceleration sensor to the reference values stored in the memory.

8 Claims, 2 Drawing Sheets

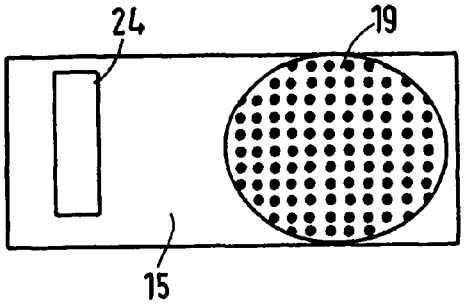
FIG.4
FIG.5
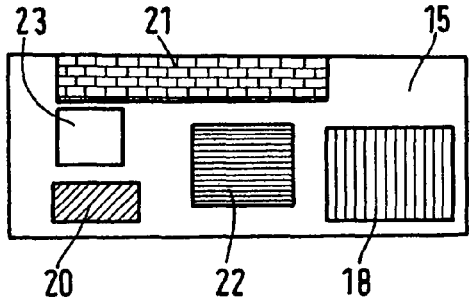
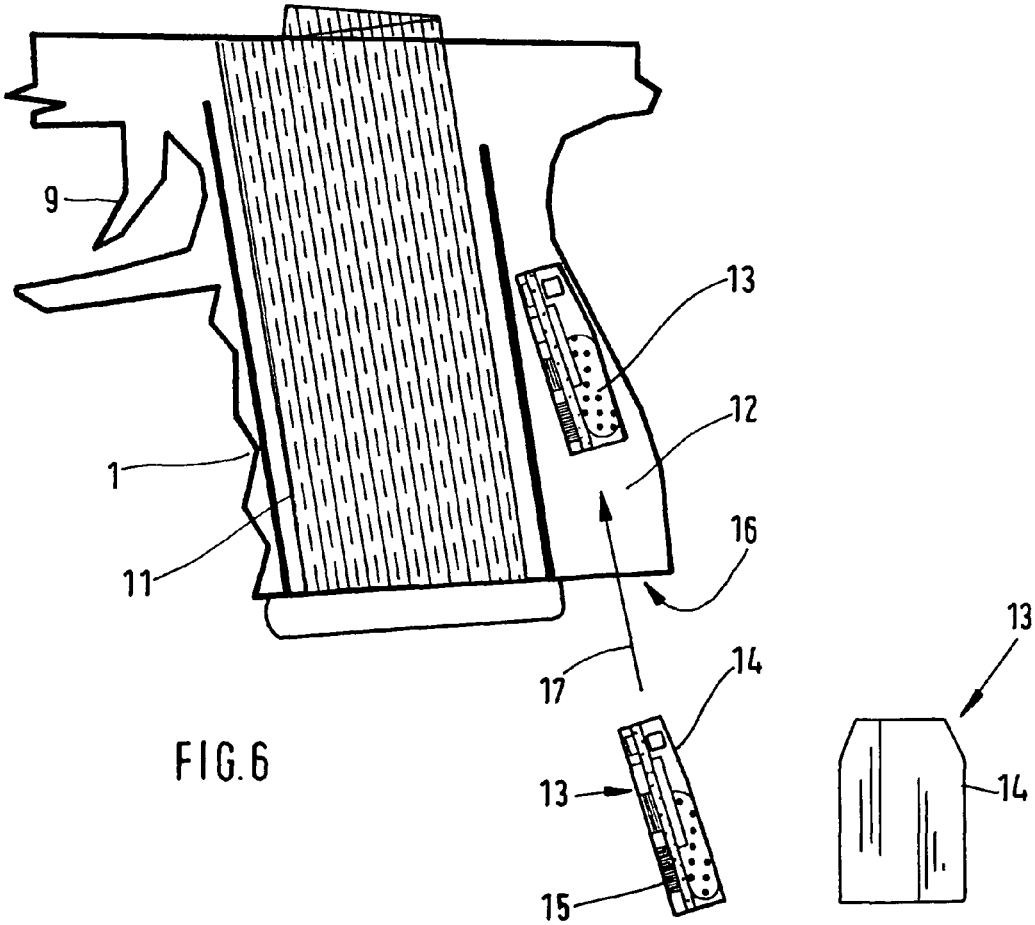
FIG.6

HANDGUN

FIELD OF INVENTION

The present invention relates to a handgun, in particular a pistol, having a device for ascertaining the shot count.

BACKGROUND OF THE INVENTION

A pistol having a piezoelectric sensor, which outputs a signal to the microprocessor upon picking up the recoil impulse during firing, is known from EP 1 300 648 B1. In addition, a coil powered by a frequency generator is provided as a further sensor, which is actuated when the slide of the pistol slides back toward the grip after firing and a metal part thereof moves over the coil. The device for ascertaining the shot count using the coil is situated between the muzzle and the trigger below the slide for this purpose. A count pulse is only delivered to the memory when the second sensor delivers a signal in a specific time interval after the signal of the piezoelectric sensor. This prevents a shot from erroneously being counted when the piezoelectric sensor is subjected to other mechanical impulses, for example, if the pistol is dropped.

The known measuring system has proven itself per se. However, the positioning of the shot counter in front of the trigger results in an undesired change of the construction and design of the pistol. The shot count may also be manipulated, for example, if the slide is held in place when firing.

A handgun according to the preamble of Claim 1 is disclosed in US 2005114084 A1. The acceleration sensor comprises a piezoceramic sensor, which is fastened on one side to the inner wall of a housing and is provided with a mass on the diametrically opposite side. The shot count is also comparatively easy to manipulate with this sensor.

The object of the present invention is to implement the device for shot count ascertainment more reliably.

SUMMARY OF THE INVENTION

This is achieved according to the present invention by the firearm characterized in Claim 1. Advantageous embodiments of the present invention are disclosed in the subclaims.

According to the present invention, an acceleration sensor, which detects the acceleration of the firearm after firing in all three spatial directions, i.e., in the X, Y, and Z axes, is used as the sensor for ascertaining the shot count. Therefore, for example, the movements of a pistol are detected, which are caused by the slide sliding back, but also by movements caused by the tilting of the firearm upward after firing and deformations and shocks of the firearm directly after firing, for example. The entire movement sequence of the firearm in time in the three spatial directions may thus be used for ascertaining a shot. The change in time of the movement intensity is thus preferably used in each of the three spatial directions for the analysis.

I.e., the signal of the acceleration sensor is recorded separately for each spatial axis to define the intensity curve of the acceleration in the corresponding direction. Thus, for example, the signal of the acceleration sensor upon firing the firearm may be recorded for each spatial axis as a diagram having the abscissa as the time axis and the acceleration intensity as the ordinate. Specific characteristic intensity maxima and possibly minima of the movement of the firearm in the three spatial directions, which are ascertained on the basis of the diagram, may be stored as reference values in the memory.

Thus, for example, due to the tilting of the pistol upward in a specific time interval after the firing, a high acceleration occurs in the Z direction or height axis. A reference value may be defined for this purpose, which results from the acceleration after this time interval, a minimum dimension for the acceleration being defined as a reference value, in order to take into consideration that the firearm may also be held with very high force. This reference value may be related to the accelerations of the firearm in the X and Y directions, i.e., to the left and right, which are significantly less in this instant in relation to the acceleration in the Z direction due to the tilting upward, so that maximum values may be defined for the acceleration in the X and Y directions at this instant as further reference values.

To define the time intervals after the firing, a further sensor is preferably provided, which outputs a signal to the microprocessor upon recording the recoil impulse upon firing. The further sensor may be a contact which is mechanically moved by the shot, for example. The further sensor is preferably a piezoelectric sensor, however. The intensity curve of the signal of the piezoelectric sensor upon firing is preferably also stored in the memory.

When the acceleration sensor outputs a signal after a mechanical impulse whose intensity curve corresponds to the stored reference values, i.e., a positive comparison with the reference values stored in the memory occurs, a count is increased in the memory by the microprocessor, i.e., the shot is stored.

In addition, the reference values for the intensity curve of the signal of the piezoelectric sensor upon firing the firearm may be stored in the memory. A mechanical impulse due to firing may already be differentiated from another mechanical impulse acting on the firearm solely through the comparison of the reference values of the piezoelectric sensor. However, the reliability achievable solely by the reference values of the piezoelectric sensor is not sufficient.

Therefore, both the reference values stored in the memory for the piezoelectric sensor and the reference values of the acceleration sensor for shot counting are preferably used in a positive comparison. Thus, for example, the reference values for the piezoelectric sensor in a first phase, i.e., in a time interval up to 10, for example, particularly 5 ms after the firing and the reference values of the acceleration sensor in a second subsequent phase of up to 150, for example, in particular 100 ms after the firing may be stored in the memory.

In addition, it may be established using the acceleration sensor whether incorrect handling of the firearm has occurred, i.e., whether it has been subjected to strains which have not been caused by a shot, for example, an overload due to impacts. Strains of this type, which lie outside the reference value for firing and may play a role for warranty claims, are thus also detectable using the acceleration sensor and storable in the memory.

The acceleration sensor which detects the acceleration of the firearm in the three spatial directions may be formed by an electronic MEM (micro-electromechanical) component, whose capacitive measurement system measures the acceleration in the relevant spatial direction. The MEM component is preferably implemented as a chip.

The signal of the piezoelectric sensor is preferably also used as a wakeup signal for the electronics. I.e., the analysis electronics, including the acceleration sensor, only become active when the piezoelectric sensor has been impinged. Instead of being generated by the piezoelectric sensor, the wakeup signal may also be generated by another sensor, which detects the shock upon tiring, e.g., a mechanical contact.

For example, a piezofilm sensor may be used as the piezoelectric sensor, for example, made of polyvinylidene fluoride (PVDF) or a PVDF copolymer. However, a piezoceramic sensor is preferably used. Specifically, in contrast to a piezofilm sensor, a piezoceramic sensor may be fastened to the printed circuit of the circuit board using a mounting retainer and thus significantly more easily. In addition, a piezoceramic sensor is more finely tunable and results in largely constant values over the temperature range coming into consideration for a firearm. The reference values stored in the memory are also largely temperature-independent.

The memory is preferably read out contactlessly, in particular with a firearm having a grip made of plastic. Specifically, an RF transmitter may be provided in the grip, which communicates with an RF receiver as the read device outside the firearm. The antenna of the RE transmitter in the grip is preferably formed by a ferrite antenna, which is mounted on the surface of the circuit board as an SMT (surface-mounted technology) antenna.

The circuit board which receives the device for ascertaining the shot count is preferably situated in the grip of the pistol, preferably behind the pistol magazine, because a space is usually available there as a result of the grip haptic.

The circuit board having the electronics for shot count ascertainment may be implemented as a plug-in module, in which the circuit board having the electronics is embedded or welded. The shot counter module may thus be inserted as a finished unit into the firearm and may be fixed in the grip by locking or self-locking. In order that the movement of the firearm is completely transmitted to the acceleration sensor, the module is fixed solidly in the firearm and the circuit board having the acceleration sensor is fixed solidly in the module.

To be able to establish be instant of the shot delivery in addition to the number of shots, a real-time clock is additionally provided on the circuit board. The pistol is thus used for event recording, because the instant of the shot delivery is recorded for every delivered shot in the memory using the real-time clock.

A battery is provided for the power supply. In inactive operation, the power supply is exclusively used for maintaining the data in the memory and operating the real-time clock and, in active operation, for ascertaining the measured values and analyzing the shot, and also for communication with attached read devices. The power supply may also occur externally during the communication.

In addition, further characteristic data of the pistol may be stored in the memory. This characteristic data may be data for identifying the pistol (unique data) or data about the owner or user of the pistol, for example. The data for identifying the pistol may be the number of the firearm, which is also attached to the firearm, as well as the production data of the pistol, lot number, model, etc., for example. For this purpose, a write device for coding the memory may be installed at the production facility. Owner data is, for example, the name of the legal owner of the firearm, which is input into the memory by the firearm dealer, an authority, or the like upon purchase of the pistol, as well as the new name in the event of a change of owner. Service activities may also be stored in the firearm in the shot counter module.

BRIEF DESCRIPTION OF THE DRAWINGS

In the following, the present invention is explained in greater detail for exemplary purposes on the basis of the drawing.

FIGS. 4 and 5, respectively, schematically show a top view on one side and the other side of the circuit board having the electronics, the sensors, and further components; and FIG. 6 schematically shows a section through the grip having the module in section and in a top view.

DETAILED DESCRIPTION

Figure 1:
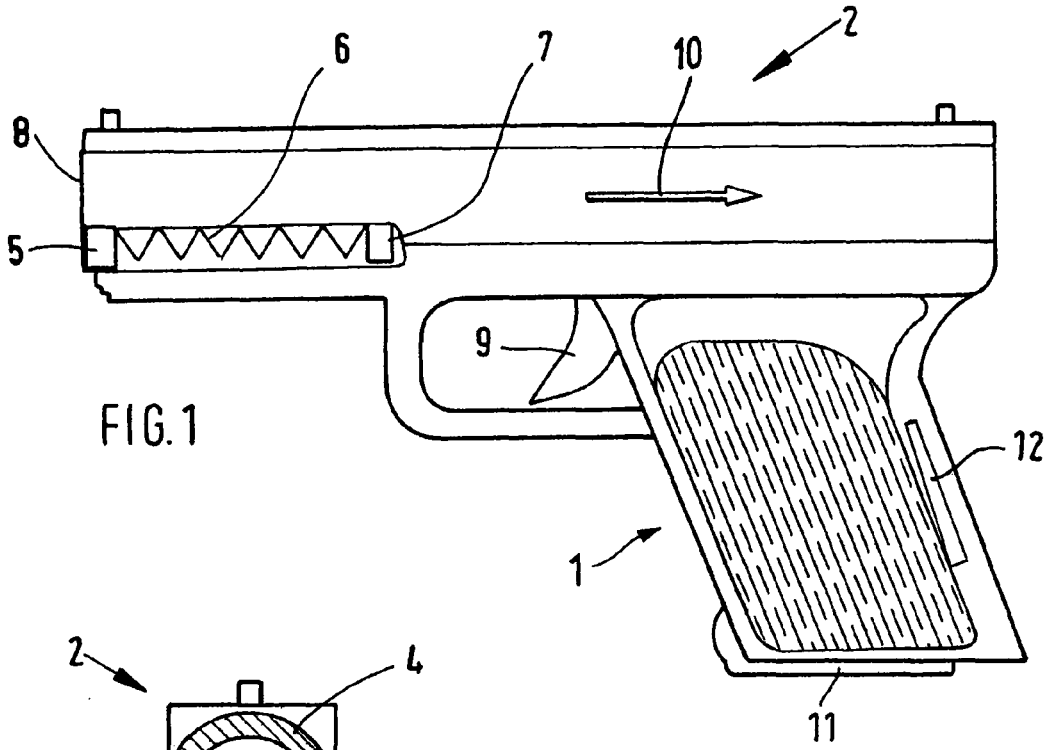
FIG. 1 schematically shows a side view of a pistol, having a partially cutaway grip.
Figure 2:
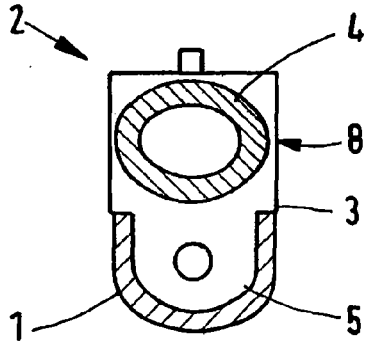
FIG. 2 schematically shows a front view of the pistol from FIG. 1.

According to FIG. 1, the pistol has a grip 1 having a slide 2, which is situated so it is displaceable on the grip 1 using a tongue/groove guide 3 (FIG. 2). The grip 1 comprises plastic.

The barrel 4 is contained in the slide 2, which is implemented as stationary, i.e., fixed on the grip. The slide 2 is provided with a front wall 5, which is used as a spring plate for a restoring spring 6, whose other end is supported at 7 on the grip 1. The mouth of the barrel 4 is identified by 8 and the trigger is identified by 9. Upon firing, the slide 2 slides backward against the force of the spring 6 in the direction of the arrow 10.

According to FIGS. 1 and 6, a recess 12, in which a module 13 is situated, which has a housing 14, which encloses the circuit board 15 having the electronics water-tight, is provided in the grip 1 behind the cartridge magazine 11, i.e., on the side of the magazine 11 facing away from the mouth 8.

The module 13 is implemented to be inserted into the grip 1 from below through an opening 16, as indicated by the arrow 17 in FIG. 6. For this purpose, the housing 14 is implemented as tapered on its forward end in the insertion direction 17. By a lock or self-locking (not shown), the module 13 plugged into the grip 1 is fixed. The lower opening 16 in the grip 1 may then be closed.

Figure 3:
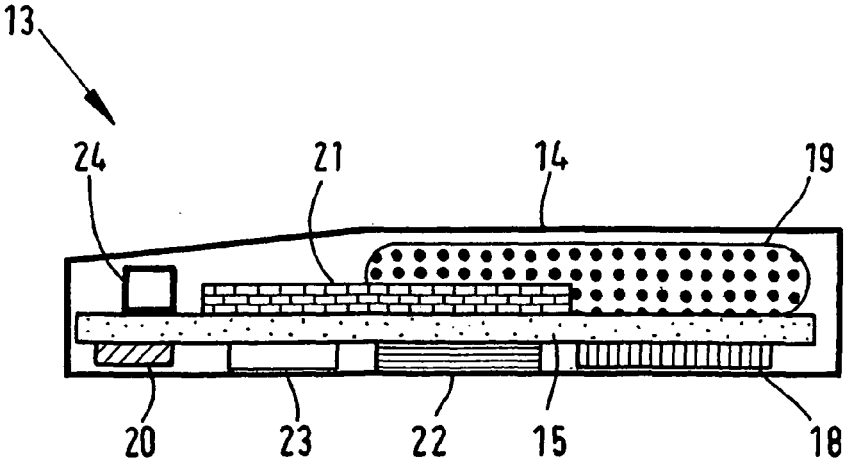
FIG. 3 schematically shows a longitudinal section through a circuit board encapsulated in a housing.

According to FIGS. 3 through 5, the circuit board 15, implemented as a printed circuit board, has a microprocessor 18, which has a nonvolatile memory as a program memory, a counter, and an event memory. A battery 19 is provided for the power supply. In addition, the circuit board 15 is provided with a real-time clock 20 and its printed circuit board is provided with a mounting retainer (not shown) having a piezoelectric sensor 21 implemented as a piezoceramic sensor, and also with an acceleration sensor 22.

The RF transmission and reception part 23, with which the circuit board 15 is equipped, has an SMT ferrite antenna 24. While the microprocessor 18, the acceleration sensor 22, the RF part 23, and the clock 20 are situated on one side of the circuit board 15, its other side is provided with the battery 19, the piezoelectric sensor 21, and the ferrite antenna 24.

The housing 24 may be formed by a plastic block in which the circuit board 15, including all components situated thereon, is embedded.

The invention claimed is:

1. A handgun having a device for ascertaining the shot count, which has electronics having a microprocessor and a memory which may be read out, a power supply, and a sensor for delivering a count pulse to the memory when a shot is delivered, the sensor being an acceleration sensor detecting the acceleration of the firearm, reference values for the intensity curve of the acceleration measured by the acceleration sensor upon firing of the firearm being stored in the memory, and said microprocessor being designed in such a way that said microprocessor outputs a count pulse to the memory in the event of positive comparison of an intensity curve of the acceleration measured using the acceleration sensor to the reference values stored in the memory, comprising the improvement wherein the acceleration sensor detects the acceleration of the firearm in all three spatial directions and a further sensor is provided, which outputs a signal to the microprocessor upon picking up the recoil impulse upon firing, the further sensor being a piezoelectric sensor, and wherein the reference values for the intensity curve of the signal of the piezoelectric sensor upon firing the weapon are stored in the memory and the microprocessor is designed in such a way that said microprocessor outputs a count pulse to the memory in the event of positive comparison of a signal output by the piezoelectric sensor to reference values stored in the memory for the piezoelectric sensor.

2. The handgun according to claim 1, wherein the signal of the piezoelectric sensor forms a wakeup signal for the electronics.

3. The handgun according to claim 1, wherein a circuit board is provided for receiving the electronics, and the piezoelectric sensor is fastened to a printed circuit for the circuit board using a mounting retainer.

4. The handgun according to claim 1, wherein a ferrite antenna, which is mounted on the surface of the circuit board, is provided for reading out the memory.

5. The handgun according to claim 1, wherein the device for ascertaining the shot count is situated in a module (13).

6. The A handgun having a device for ascertaining the shot count, which has electronics having a microprocessor and a memory which may be read out, a power supply, and a sensor for delivering a count pulse to the memory when a shot is delivered, the sensor being an acceleration sensor detecting the acceleration of the firearm, reference values for the intensity curve of the acceleration measured by the acceleration sensor upon firing of the firearm being stored in the memory, and said microprocessor being designed in such a way that said microprocessor outputs a count pulse to the memory in the event of positive comparison of an intensity curve of the acceleration measured using the acceleration sensor to the reference values stored in the memory, comprising the improvement wherein the acceleration sensor detects the acceleration of the firearm in all three spatial directions, and wherein the handgun is formed by a pistol and the device for ascertaining the shot count is situated in the grip of the pistol.

7. The handgun according to claim 6, wherein the device for ascertaining the shot count is situated on a side of a cartridge magazine in the grip of the pistol facing away from a mouth of the pistol.

8. A handgun having a device for ascertaining the shot count, which has electronics having a microprocessor and a memory which may be read out, a power supply, and a sensor for delivering a count pulse to the memory when a shot is delivered, the sensor being an acceleration sensor detecting the acceleration of the firearm, reference values for the intensity curve of the acceleration measured by the acceleration sensor upon firing of the firearm being stored in the memory, and said microprocessor being designed in such a way that said microprocessor outputs a count pulse to the memory in the event of positive comparison of an intensity curve of the acceleration measured using the acceleration sensor to the reference values stored in the memory, comprising the improvement wherein the acceleration sensor detects the acceleration of the firearm in all three spatial directions, the device for ascertaining the shot count being situated in a module and the grip being provided with an opening for inserting the module from below.

* * * * *